United States Patent [19]

Bofinger et al.

[11] 4,430,974

[45] Feb. 14, 1984

[54] FUEL INJECTION PUMP FOR INTERNAL COMBUSTION ENGINES

[75] Inventors: Günter Bofinger, Vaihingen; Werner Faupel, Gerlingen, both of Fed. Rep. of Germany

[73] Assignee: Robert Bosch GmbH, Stuttgart, Fed. Rep. of Germany

[21] Appl. No.: 417,976

[22] Filed: Sep. 14, 1982

[30] Foreign Application Priority Data

Dec. 5, 1981 [DE] Fed. Rep. of Germany ..... 3148214

[51] Int. Cl.[3] ..... F02M 59/20

[52] U.S. Cl. ..... 123/387; 123/460; 123/464; 123/502

[58] Field of Search ..... 123/460, 464, 459, 502, 123/367, 369, 387, 449, 446

[56] References Cited

U.S. PATENT DOCUMENTS 3,968,779 7/1976 Davis ..... 123/502
4,334,514 6/1982 Konrath et al. ..... 123/502
4,359,994 11/1982 Hofer et al. ..... 123/502

FOREIGN PATENT DOCUMENTS 54-10830 1/1979 Japan ..... 123/387
54-10831 1/1979 Japan ..... 123/387

*Primary Examiner*—Ira S. Lazarus
*Assistant Examiner*—Magdalen Moy
*Attorney, Agent, or Firm*—Edwin E. Greigg

[57] ABSTRACT

A fuel injection pump for an internal combustion engine is proposed having an adjustment piston for the adjustment of the onset of the injection, on which an rpm-proportional fuel pressure determined by a pressure control valve and a pressure valve placed behind it and controllable in dependence on temperature acts. An adjustment device controls a full load stop for the limitation of the full-load fuel maximally injected by the fuel injection pump. The adjustment device has a movable piston for this purpose disposed movably in a work bore. The circumference of the piston is formed as a cam and is scanned by a scanner determining the position of the full load stop. The movable piston is acted on one side by the fuel pressure in the suction chamber and on the other side by a spring and by the fuel pressure between the pressure control valve and the pressure valve. This results in a compensation of the fuel pressure force at the movable piston, which is caused by the pressure valve.

4 Claims, 1 Drawing Figure

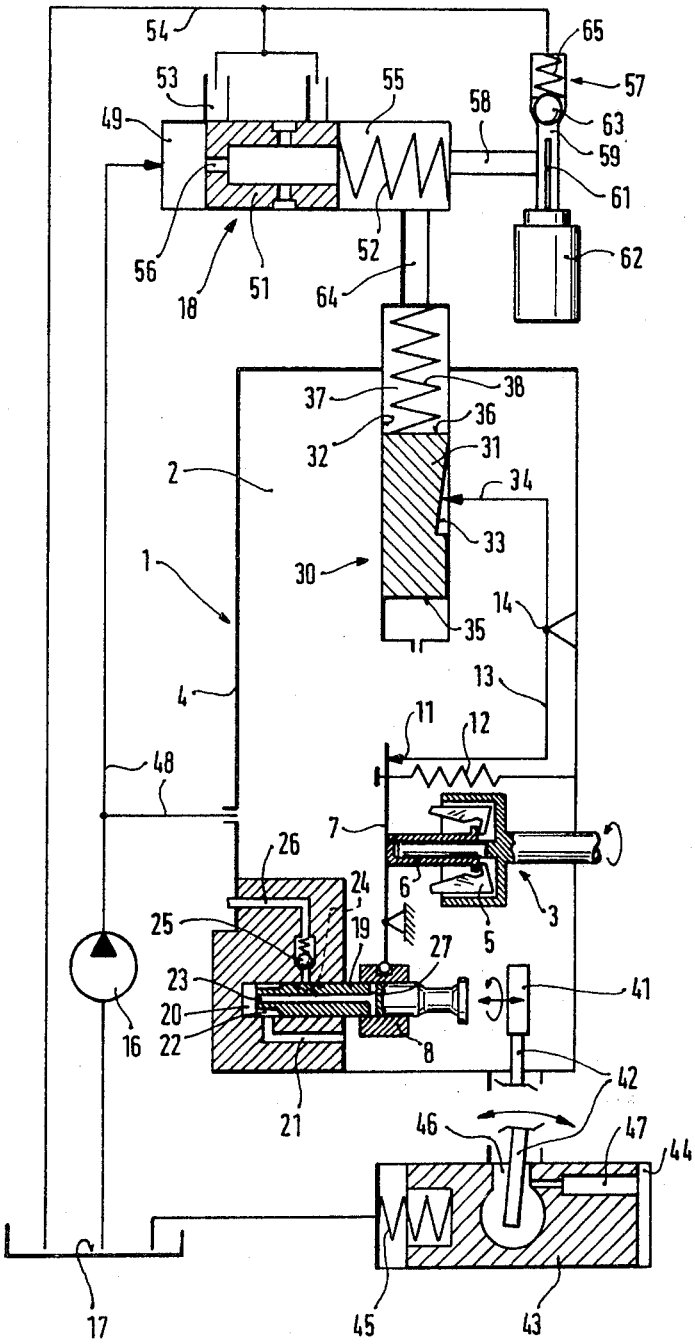
54
65
53
55
57
58
49
63
59
61
56
52
62
18
51
64
37
38
36
32
31
2
34
33
1
30
14
35
13
4
11
12
48
7
26
6
24
3
25
19
5
27
23
41
20
16
22
8
42
21
46
47
44
17
45
43

FUEL INJECTION PUMP FOR INTERNAL COMBUSTION ENGINES

BACKGROUND OF THE INVENTION

The invention is based on a fuel injection pump of the type revealed hereinafter. A fuel injection pump is already known wherein the normally rpm-dependent fuel pressure, which changes the onset of the injection, can be changed by a valve operating in accordance with temperature. By this change the onset of the injection is displaced towards "early" during cold starting to such a degree that sufficient time remains for the preparation of the fuel and a correspondingly better ignition or combustion can take place. Here the ambient temperature or the coolant temperature is taken into consideration. It is furthermore known to dispose an adaptation device on fuel injection pumps determining the position of the full-load stop, which acts on a control arm connected with the supply volume adjustment element of the fuel injection pump, and limits its adjusting path for the setting of the maximally permissible full-load supply volume. The simultaneous action of these two devices, the so-called cold start acceleration device and the hydraulic adaptation device for the compensation of the maximally permissible full load supply volume, is not possible since the cold start acceleration device causes pressure changes in the suction chamber of the fuel injection pump which result in unwanted volume changes by the hydraulic adaptation device in a cold internal combustion engine.

OBJECT AND SUMMARY OF THE INVENTION

In contrast with the foregoing, the fuel injection pump in accordance with the present invention, as described hereinafter and finally claimed, has the advantage that the hydraulic adaptation device for the determination of the maximally permissible full load supply volume and the hydraulic automatic cold start acceleration device can function simultaneously, even in a cold internal combustion engine, without the occurence of unwanted volume changes by the hydraulic adaptation device.

The invention will be better understood and further objects and advantages thereof will become more apparent from the ensuing detailed description of a preferred embodiment taken in conjunction with the drawings.

DESCRIPTION OF THE PREFERRED EMBODIMENT

As an example of a fuel injection pump the drawing shows in simplified form a distributor injection pump 1 for a Diesel internal combustion engine with a mechanical rpm governor integrated into the suction chamber 3, which governor is placed on the pump housing. A flyweight governor 5 of the rpm governor 3 actuates, in a known manner, via a governor sleeve 6 and a control arm 7 an annular slide 8 serving as supply volume adjustment element of the distributor injection pump 1, the position of which, controlled by the control arm 7, controls the delivery end of the distributor injection pump 1. In the full load position shown the control arm 7 touches a full load stop 11. The initial stressing force of a control spring 12 keeping the control arm 7 on contact with the full load stop 11 determines the breakaway rpm. The full load stop 11 is formed on a trip lever 13 which, developed as a two-armed lever, is disposed in a swingable manner around a pivot point 14 fastened to the housing. Fuel is fed from a fuel tank 17 by a supply pump 16 to the inner chamber of the fuel injection pump housing 4 serving as suction chamber 2, and the fuel pressure is controlled depending on the rpm by a pressure control valve 18 on the pressure side of the supply pump 16. A pump work chamber 20, acted upon by a pump piston 19, which reciprocates and rotates at the same time, is filled during the suction stroke of the pump piston 19 via a suction bore 21 and control grooves 22 of the pump piston 19. The pressure chamber 20 of the injection pump communicates through axial grooves 22 in the piston and a channel 21 in the housing with a sump which is supplied with fuel by a fuel supply pump 16. After executing a downward suction stroke, the piston is rotated, thereby closing the channel 21 after which the piston assumes its upward stroke, thereby pressurizing the fuel now contained in the pressure chamber 20. During this time, fuel is delivered under high pressure through an axial channel 23 into a radial bore and an axial distribution groove 24 in the periphery of the pump piston. The housing contains a plurality of fuel pressure lines 26 which are thus supplied sequentially during the rotation of the pump piston. The number of pressure lines 26 is equal to the number of engine cylinders. Each of the pressure lines 26 may contain a check valve 25 opening in the direction of fuel supply.

The fuel pump 16 takes fuel from a storage container 17 and delivers it to the sump. The pump 16 is driven at engine speed or a speed proportional to engine speed and is a volumetric pump whose flow volume increases with speed. The pressure within the sump is controlled by controlling the amount of return flow of fuel in a manner which will be understood as the description progresses. At the end of supply a lateral bore 27, connected with the longitudinal bore 23, of the pump piston 19 is opened by the annular slide 8.

The position of the trip lever 13 and thus of the full load stop 11 is determined by an adjustment device 30 having a control element developed as a piston 31, which is slidingly disposed in a cylinder which is integral with the housing. A work bore 32 is provided in the cylinder. A cam is provided on the surface of the piston 31, and this cam is scanned by a follower means 34 of the trip lever 13. The fuel pressure in the suction chamber 2 acts on one end face 35 of the piston 31, while the other end face 36 of the piston 31 extends into a chamber 37 in said cylinder, and in which chamber a spring means 38 is supported on the end face 36.

An adjustment piston 43 acts, by way of a pin 42, on the known cam drive 41 of the fuel injection pump 1 for the purpose of adjusting the time of the onset of the injection. The longitudinal axis of the adjustment piston 43 extends vertically to the plane of the drawing, however, for technical reasons in connection with the drawing it has been turned into the drawing plane. The adjustment piston 43 is movable against a return spring 45 by the fuel present in a work chamber 44 in such a way that the farther the adjustment piston 43 is displaced in the direction of the return spring 45, the injection time in regard to top dead center of the engine piston of the internal combustion engine is moved towards "early". A connecting conduit 46 leads from the suction chamber 2 of the fuel injection pump 1 to a bore 47 in the adjustment piston 43 and ends in the work chamber 44.

A pressure line 48 upstream of the supply pump 16 not only leads to the suction chamber 2, but also to a pressure chamber 49 of the pressure control valve 18. The fuel pressure prevailing upstream of the supply pump 16, that means also the pressure in the suction chamber 2, is controlled dependent on the rpm by the pressure control valve 18, wherein the pressure increases proportionally with an increase in rpm. This rpm-dependent pressure also prevails in the work chamber 44, so that with increased rpm and thereby increasing pressure the adjustment piston 43 is moved towards "early". The pressure control valve 18 acts together with a piston 51 serving as a movable wall, which piston 51, movable against a control spring 52, limits the pressure chamber 49 on one side and more or less opens a gradual shut-off opening 53, by way of which fuel can flow into a return line 54 and from there to the fuel tank 17. A return chamber 55, containing the control spring 52, of the pressure control valve 18 is connected via a throttle bore 56 in the piston 51 with the pressure chamber 49.

As is known, the injection in a Diesel engine takes place when the engine piston is in the area of top dead center. The time of the onset of the injection is, depending on the rpm, from ahead to shortly after top dead center, generally earlier during high rpm than during lower rpm. While the time needed by the fuel for the distance between the fuel injection pump and the injection nozzle remains largely constant without dependence on the rpm, the time needed for pump output and combustion changes with the rpm. This change of the time relationship is compensated for by the injection timing adjustment device, and a large part of its capacity is used for this purpose. The remainder of its capacity serves, depending on the demands, to obtain an improvement of the fuel consumption or the performance or the engine noise and/or the exhaust gas. As is known, the ignition delay of a Diesel internal combustion engine is dependent on the temperature of the fuel and of the cylinder wall. To compensate for this ignition delay it is advantageous in cold internal combustion engines to advance the onset of injection during lower rpm. In warm internal combustion engines, however, this would lead to hard running, and the internal combustion engine would be noisy. An advance is also advantageous during starting, as is also known, in order to achieve a quick acceleration of the internal combustion engine. A further characteristic of a cold internal combustion engine is that it develops less blue smoke during advanced injection onset than during a late injection onset.

It is advantageous for the warm-up of the internal combustion engine if the fuel pressure in the suction chamber 2 and with it that in the work chamber 44 of the adjustment piston 43 is relatively high in order thereby to achieve a temporary additional advanced setting of the injection onset. An increase in pressure, however, requires a decrease of the gradual shut-off diameter at the gradual shut-off opening 53 of the pressure control valve 18 for the returning fuel volume. A pressure valve 57 is disposed in series with the pressure control valve 18 in order to influence the fuel pressure in accordance with temperature during the starting of the internal combustion engine. For this purpose a discharge conduit 58 leads from the return chamber 55 of the pressure control valve 18 to a gradual shut-off chamber 59 of the pressure valve 57, which comprises the cold start acceleration device. An actuation member 61 of a temperature-dependent element 62 extends into the gradual shut-off chamber 59, the element being, for instance, made from an expanding substance of a bimetal spring, which acts on the movable valve part 63 of the pressure valve 57 in such a way that only with temperatures above the operational temperature of the internal combustion engine the movable valve part 63 is moved by the actuation member 61 into the opening position of the pressure valve 57.

In accordance with the present invention it is intended that the fuel pressure between the pressure control valve 18 and the pressure valve 57 should prevail in the adaptation chamber 37 of the adjustment device 30, wherefore a line 64, as shown in the drawing, leads, for instance, from the return chamber 55 to the chamber 37; the line 64 can, however, also lead from the discharge conduit 58 or the gradual shut-off chamber 59 to the chamber 37. During a start below the operational temperature of the internal combustion engine the fuel pressure in the gradual shut-off chamber 59, the discharge conduit 58 and the return chamber 55, which also prevails in the chamber 37 by way of the line 64, is determined by the opening pressure of the pressure valve 57, which the movable valve part 63 opens toward the return line 54 against the force of a valve spring 65. This fuel pressure controlled by the pressure valve 57, combined with the control spring 52, creates a force in the direction of closing of the piston 51, whereby the gradual shut-off opening 53 is further closed and the fuel pressure on the pressure side of the supply pump 6 and, with it, also in the suction chamber 2, is increased by a differential pressure $P_{diff}$, which also acts on the end face 35 of the device 30. The differential pressure $P_{diff}$ controlled by the pressure valve 57 also acts on the end face 36 of the piston 31, so that the pressure forces resulting from the differential pressure $P_{diff}$ and acting on the piston 31 in opposite directions cancel each other out and the piston 31 is not moved into a position, caused by the higher fuel pressure in the suction chamber 2 because of the cold start acceleration device during cold start, which would lead to an unwarranted increase in the maximally permissible full load amount.

The foregoing relates to a preferred exemplary embodiment of the invention, it being understood that other embodiments and variants thereof are possible within the spirit and scope of the invention, the latter being defined by the appended claims.

What is claimed and desired to be secured by letters patent of the United States is:

1. In a fuel injection pump for an internal combustion engine, including:

an rpm proportional fuel supply pump;

a housing within which a suction chamber is defined, into which fuel is supplied by the fuel supply pump as a function of rpm;

a control arm, a fuel injection quantity adjustment member, full load stop means, and a mechanical rpm governor situated within the suction chamber, said control arm being acted on by said mechanical rpm governor and being connected to the fuel injection quantity adjustment member, said adjustment member having an adjustment path which is limited by the full load stop means for the purpose of setting the maximum allowable full load fuel injection quantity;

an adjustment element and means defining a restoring force, said adjustment element being fuel operated against the restoring force for regulating the onset of fuel injection;

a pressure control valve including a pressure chamber, a return chamber, a shut-off opening, a movable wall separating the pressure chamber from the return chamber, and means generating a restoring force applied to the movable wall, said movable wall controlling the extent of opening of the shut-off opening; and a pressure valve situated downstream of the pressure valve, said pressure valve operating as a function of at least one engine operating parameter, said pressure valve and said pressure control valve both serving to influence the fuel pressure of the fuel injection pump, the improvement comprising:

an adjustment device including a movable adjusting element, and spring means exerting a force against one end of the movable adjusting element, wherein:

(i) the position of the control arm is influenced by the adjustment device;

(ii) the adjustment device is connected to have the suction chamber pressure applied to the movable adjusting element in opposition to the force exerted by the spring means; and (iii) the adjustment device is connected between the pressure valve and the pressure control valve such that the pressure between the pressure valve and the pressure control valve is applied in the direction of the force exerted by the spring means.

2. In the fuel injection pump as defined in claim 1, further wherein:

(iv) the adjustment device further includes a control cam controlled by the movable adjusting element.

3. In the fuel injection pump as defined in claim 2, wherein the movable adjusting element is a movable piston and the control cam is formed on the movable piston.

4. In the fuel injection pump as defined in claim 2, further wherein:

(v) the adjustment device defines a work bore within which said movable adjusting element slides, one end face of said movable adjusting element being exposed to the pressure in the suction chamber and the other end face being exposed to the force exerted by the spring means and the pressure between the pressure valve and the pressure control valve.

* * * * *